US007490969B2

(12) United States Patent
Sun et al.

(10) Patent No.: US 7,490,969 B2
(45) Date of Patent: Feb. 17, 2009

(54) MODULATED LIGHTING DEVICE

(75) Inventors: Tsung-Ting Sun, Taipei Hsien (TW); Hung-Ta Liao, Taipei Hsien (TW); Tzu-Hsuan Yen, Taipei Hsien (TW); Pao-Shen Chen, Taipei Hsien (TW)

(73) Assignee: Edison Opto Corporation, Taipei Hsien (TW)

( * ) Notice: Subject to any disclaimer, the term of this patent is extended or adjusted under 35 U.S.C. 154(b) by 4 days.

(21) Appl. No.: 11/808,871

(22) Filed: Jun. 13, 2007

(65) Prior Publication Data

US 2008/0158879 A1 Jul. 3, 2008

(30) Foreign Application Priority Data

Dec. 29, 2006 (TW) ..... 95223252 U

(51) Int. Cl.
*F21V 7/04* (2006.01)

(52) U.S. Cl. ..... 362/612; 362/600

(58) Field of Classification Search ..... 362/600–634, 362/235–247

See application file for complete search history.

(56) References Cited

U.S. PATENT DOCUMENTS 6,206,548 B1 * 3/2001 Lassovsky ..... 362/283

* cited by examiner

*Primary Examiner*—Anabel M Ton
(74) *Attorney, Agent, or Firm*—Rosenberg, Klein & Lee

(57) ABSTRACT

A modulated lighting device is applied to provide modulated illumination toward a selected region. The device comprises a light box shell, a plurality of Light Emitting Diodes (LEDs), and a plurality of modulation assemblies. The light box shell comprises at least one illumination opening, the LEDs are arranged within the shell for providing a plurality of injection light beams, and the modulation assemblies are arranged in a preset array and pivotally connected with the light box shell neighboring to the illumination opening. Each modulation assembly comprises at least one reflection element to reflect the injection light beams for generating at least one illumination light beam. Thereafter, the illuminating light beams generated from the modulation assemblies pass through the illumination opening, and each of the illuminating light beams is modulated with the neighbor illuminating light beams to provide modulated illuminating toward the selected region.

20 Claims, 5 Drawing Sheets

MODULATED LIGHTING DEVICE

FIELD OF THE INVENTION

The present invention relates to a lighting device, and more particularly to a modulated lighting device for reflecting and modulating a plurality of illumination light beams via a plurality of modulation assemblies arranged in a preset array.

BACKGROUND OF THE INVENTION

In daily life, for exactly identifying environment and directions in the dark, illumination devices have already been indispensable tools. Most existed illumination devices have a light tube or a bulb served as a light source respectively, and further more, the light tube or light bulb may be a fluorescent light tube, an incandescent light bulb, a halogen light tube, a halogen light bulb, and so on.

Among the light tubes or bulbs, the fluorescent light tube are widely used by the most people due to the reasons of the power consumption of the fluorescent light tube is one quarter of the incandescent light bulb, the life of the fluorescent light tube is 5 to 10 times of the incandescent light bulb, the fluorescent light tube can provide homogeneous illumination, and the fluorescent light tube can be used for wide-angle illumination. Meanwhile, for providing wider-field, higher illumination values, and more modulated illumination, a plurality of fluorescent tubes and proper light modulation plates are assembled into a light box shell, so as to assemble a fluorescent light assembly being capable of providing modulated illumination. Following up, we will disclose the structure and the working principle of the mentioned fluorescent light assembly.

Please refer to FIG. 1, which is a perspective view that illustrates a conventional fluorescent light assembly being capable of providing modulated illumination. As shown in FIG. 1, a fluorescent light assembly 1 includes a light box shell 11, a plurality of crosswise light modulation plates 12, lengthwise light modulation plates 13 (only shown one in FIG. 1), paired electrode holders 14, and fluorescent light tubes 15. The light box shell has an arrangement surface 111, an illumination surface 112, and an illumination opening 113. The arrangement surface 111 is located inside the light box shell 11, the illumination surface 112 is located outside the light box shell 11 with respect to the arrangement surface 111, and the illumination opening 113 is formed on the illumination surface 112.

Each of the crosswise light modulation plates 12 is arranged between the arrangement surface 111 and the illumination surface 112, parallel to the other crosswise light modulation plates 12, and inserted into the light box shell 11. Similarly, each of the lengthwise light modulation plates 13 is arranged between the arrangement surface 111 and the illumination surface 112, parallel to the other lengthwise light modulation plates 13, vertical to the crosswise light modulation plates 113, and inserted into the light box shell 11. Meanwhile, the crosswise light modulation plates 12 and the lengthwise light modulation plates 13 are formed with wavy surfaces extended along their extension directions.

The paired electrode holders 14 are arranged on the arrangement surface 111, and the fluorescent light tubes 15 are assembled into the electrode insertion holes (not shown in FIG. 1) of the paired electrode holders 14. Each of the fluorescent light tubes 15 is parallel to the other fluorescent light tubes 15 and the lengthwise light modulation plates 13, and vertical to the crosswise light modulation plates 12.

After the fluorescent light tubes 15 project the illumination light beams, some of the illumination light beams are projected toward the crosswise light modulation plates 12 and the lengthwise light modulation plates 13, reflected from the wavy surfaces, modulated with the other illumination light beams, which have not projected toward the crosswise light modulation plates 12 and the lengthwise light modulation plates 13 yet, and then projected out of the illumination opening, so as to provide modulated illumination. Due to the related techniques are well known by most people, so that it is not described any further hereinafter.

People skilled in related arts can easily realized that, in prior arts, due to the crosswise light modulation plates 12 and the lengthwise light modulation plates 13 are directly inserted into the light box shell 11, so that they are not able to change the direction of the reflection surfaces, i.e., the wavy surfaces are mentioned, with respect to the light box shell 11. Obviously, they are not able to adjust the illumination value, which is provided to any selected region of external environment.

Nevertheless, when triggering the fluorescent light assembly lighting, the electrons released due to that the electrodes impact the particles, which are usually the particles of mercury vapor within the fluorescent light tube to stimulate the phosphor coated on the inner surface of the fluorescent light tube, which is projecting white light. However, the phosphor distributed on the inner surface of the fluorescent light tube usually contains heavy metals, such as mercury, so that it is difficult to be recycled and makes more pollution problems.

In another aspect, since a light emitting diode (LED) has the advantages of lightweight, less volume, low power consumption, and long working life, etc., and it is gradually used to illumination devices. Following up, we will provide brief description about the lighting principle of the LED. The lighting principle of LED is translating electric power to light energy, that is, doping a minute amount of carriers into a conjunction of P-type side and N-type side and continuously combining the minute amount of carriers with a major amount of carriers to form a LED. To be with the good performance of the LED radiation may need a large amount of pairs of electrons and holes.

The space charge layers become narrower when applying a forward biased voltage, and then a major amount of carriers are doped into the P-type side and the N-type side according to Fermi characteristic energy level deviation. Due to that the minute amount of carriers are increased on the P-type side and N-type side, the pairs of electrons and holes located on the P-type side and the N-type side are recombined to release sufficient photons. In the present, the categories of LED generally include AlGaP and GaN series.

Additionally, although the electric power consumption of the fluorescent light is just one quarter of the incandescent light, the working life of the fluorescent light is five to ten times of the incandescent light. But the electric power consumption of the LED is just one eighth of the incandescent light, and the working life of the fluorescent light is fifty to one hundred times of the incandescent light. Comparing with the fluorescent light, the LED not only can save electric power and work in a long life, but also can work in a lower lighting temperature. However, due to the intensity of illumination light beam of emitted from the LED is highly influenced by the value of stimulating voltage and has obviously orientation, so that it cannot provide modulated illumination toward any selected region.

SUMMARY OF THE INVENTION

The problems intend being solved in the present invention and the objects of the present invention are described as follows:

Summarizing above description, since the LED has the advantages of lower electric power consumption, longer working life, and lower lighting temperature with respect to the fluorescent lamp, therefore, if it is possible to improve the homogeneity and lambency of illumination, the LED will have more commercial values to replace the fluorescent light and be applied in wide-angle illumination devices.

Thus, the primary object of the present invention provides a modulated lighting device using a plurality of LEDs served as light sources for projecting a plurality of injection light beams, and using a plurality of modulation assemblies arranged in a preset array for reflecting the injection light beams to project a plurality of illumination light beams. Thus, each of the illumination light beams can be modulated with the other illumination light beams neighboring to it to provide modulated illumination toward selected regions.

The secondary object of the present invention provides a modulated lighting device using a plurality of LEDs served as light sources for projecting a plurality of injection light beams, and connecting with a plurality of modulation assemblies with different light-reflection performances to provide many different kinds of modulated illumination toward selected regions via a plurality of combinations of different light-reflection performances.

Another object of the present invention provides a modulated lighting device using a plurality of LEDs served as light sources for projecting a plurality of injection light beams, and pivotally connecting with a plurality of modulation assemblies. Thus, it is able to adjust the illumination value that the modulated lighting device provides toward any selected region by rotating the modulation assemblies.

Means of the present invention for solving problems:

Means of the present invention for solving the problems as mentioned above provide a modulated lighting device for providing modulated illumination toward at least one selected region. The device comprises a light box shell, a heat-dissipating plate, a plurality of light emitting diodes (LEDs), and a plurality of modulation assemblies. The light box shell comprises at least one illumination opening, and the heat-dissipating plate is arranged within the light box shell for dissipating lighting heat when providing modulated illumination.

The LEDs are arranged on the heat-dissipating plate for providing a plurality of injection light beams, and the modulation assemblies are arranged in a preset array. Each of the modulation assemblies are pivotally connected to the light box shell neighboring to the illumination opening, and comprises at least one reflection element for reflecting the injection light beams to generate at least one illumination light beam. Each of the illumination light beams respectively reflected from the modulation assemblies can be modulated with the other neighbor illumination light beams to provide modulated illumination toward the selected region.

Effects of the present invention with respect to prior arts:

Make a comparison between the modulated lighting device of the present invention and the fluorescent light assembly, the power consumption of the LEDs is one half of the fluorescent light tube, while the working life of the LEDs can reach to ten times of that of the fluorescent light tube. Besides, the modulated lighting device can reduce pollution toward environment due to that no phosphor with polluted heavy metal element is necessary to be coated within LEDs. Thus, making a summary of above description, the means of the present invention not only can provide homogenous illumination, but also can provide the effects of reducing power consumption, increasing working life, and reducing pollution toward environment.

Meanwhile, in the present invention, it can provide many different kinds of modulated illumination toward selected regions via a plurality of combinations of modulation assemblies with different light-reflection performances. Moreover, due to the modulation assemblies are pivotally connected to the light box shell in the present invention, so that it is able to adjust the illumination value that the modulated lighting device provides toward any selected region by rotating the modulation assemblies. Thus, the present invention can provide many different kinds of modulated illumination meeting various requirements of illumination.

The devices, characteristics, and the preferred embodiment of this invention are described with relative figures as follows.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Due to that the modulated lighting device as provided in accordance with the present invention can widely provide many different kinds of modulated illumination toward at least one selected region, the combined applications are too numerous to be enumerated and described, so that we only disclose a preferred embodiment and six applications for representation.

Figure 1:
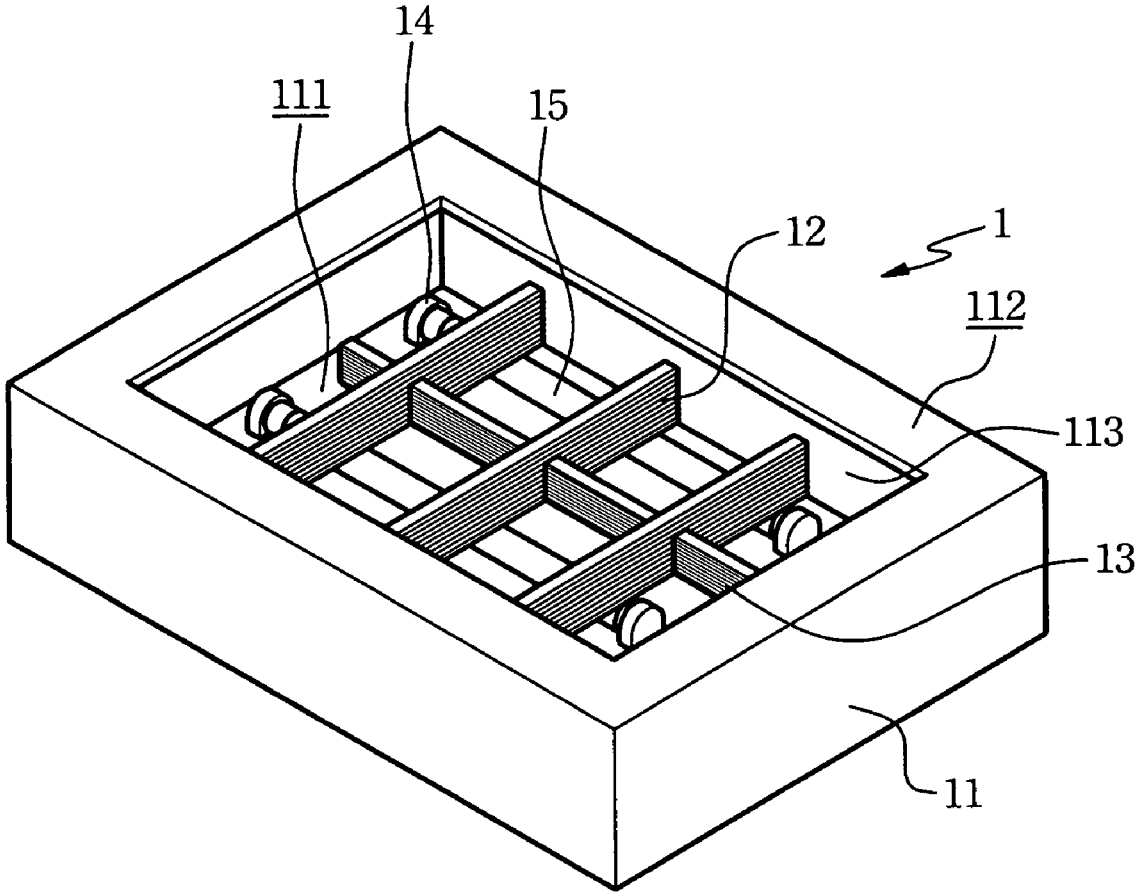
F I G . 1 ( Prior Art )
FIG. 1 is a perspective view that illustrates a conventional fluorescent light assembly being capable of providing modulated illumination.
Figure 2:
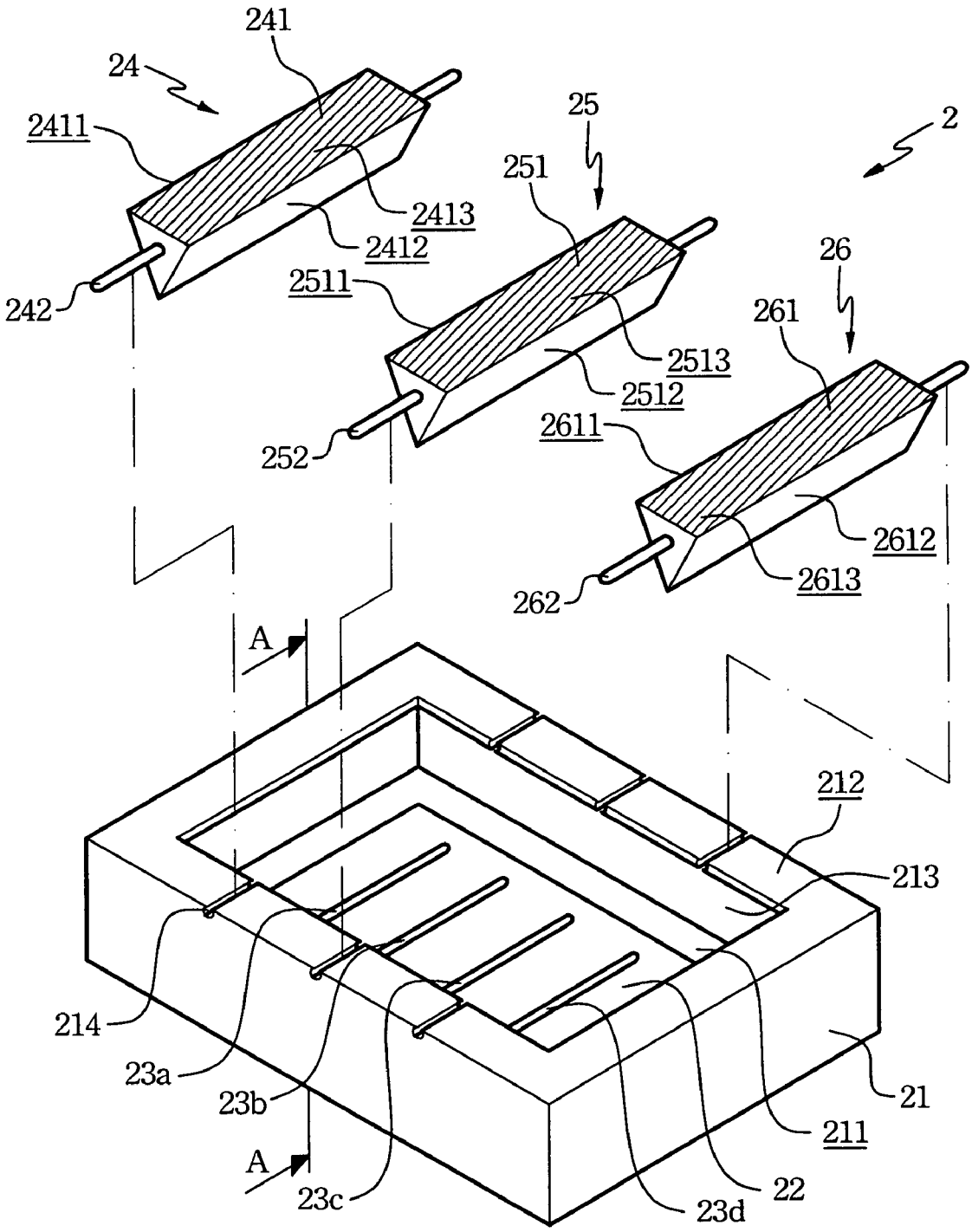
FIG. 2 is a perspective view illustrates that a plurality of modulation assemblies are removed from a light box shell in accordance with a preferred embodiment of the present invention.
Figure 3:
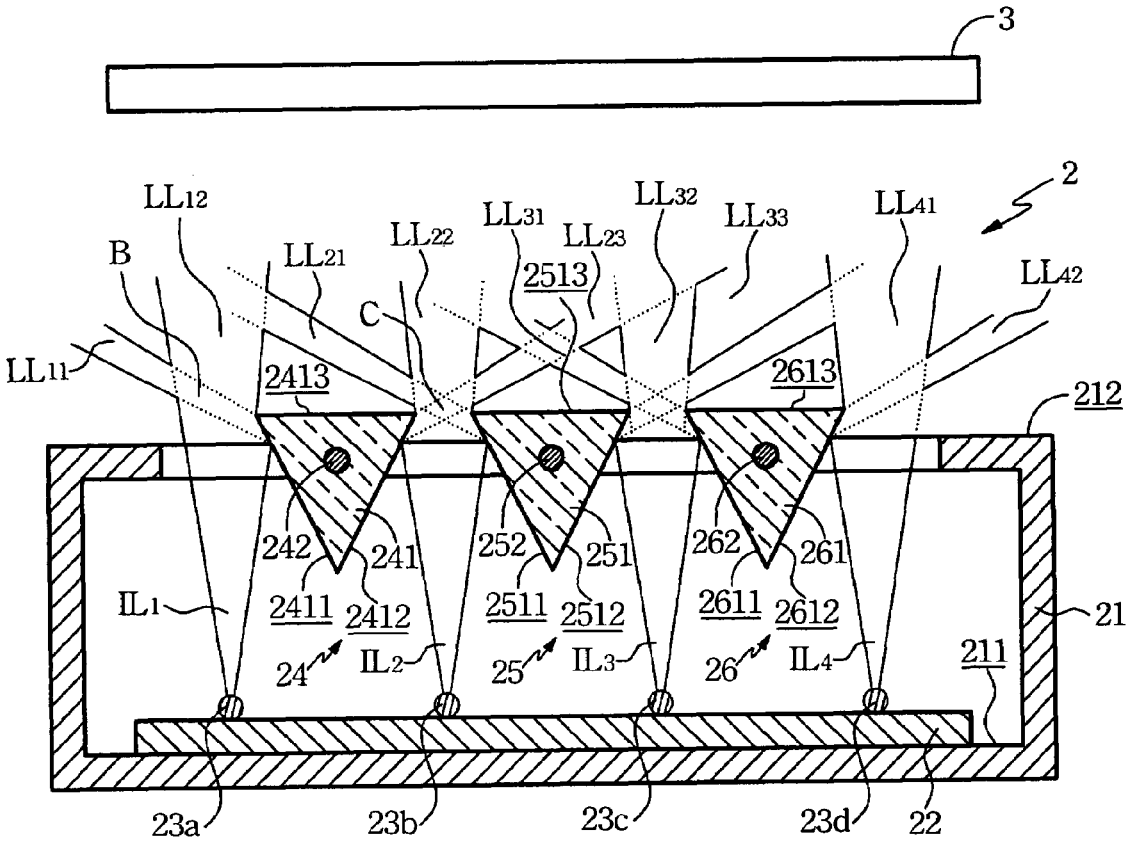
FIG. 3 a sectional view along a line A-A of FIG. 2 illustrates the modulation assemblies pivotally connected to the light box shell and the modulation situation of a plurality of illumination light beams.

Please refer to FIG. 2 and FIG. 3. FIG. 2 is a perspective view illustrates that a plurality of modulation assemblies are removed from a light box shell in accordance with a preferred embodiment of the present invention. FIG. 3 a sectional view along a line A-A of FIG. 2 illustrates the modulation assemblies pivotally connected to the light box shell and the modulation situation of a plurality of illumination light beams, so as to explain that the preferred embodiment can provide modulated illumination toward the selected region(s). As shown in FIG. 2, a modulated lighting device 2 is applied to provide a modulated illumination toward a selected region 3 (shown in FIG. 3), and comprises a light box shell 21, a heat-dissipating plate 22, four light emitting diodes (LEDs) 23*a*, 23*b*, 23*c*, 23*d*, and three modulation assemblies 24, 25, and 26.

The light box shell 21 has an arrangement surface 211, an illumination surface 212, an illumination opening 213, and a plurality of female connection mechanisms 214, wherein the arrangement surface 211 is located inside the light box shell 21, the illumination surface 212 is located outside the light box shell 21, the illumination opening 213 is formed on the illumination surface, the female connection mechanisms 214 are located between the illumination surface 212 and arrangement surface 211 neighboring to the illumination opening 213.

In the preferred embodiment, the female mechanisms 214 are a plurality of pair connection grooves as shown in FIG. 2, while in applications, the female mechanisms 214 also can be a plurality of pairs of connection holes. The heat-dissipating plate 22 is arranged on the arrangement surface 211 for dissipating lighting heat when providing modulated illumination toward the selected region 3. Each of the four LEDs 23*a*, 23*b*, 23*c*, and 23*d* is arranged on the heat-dissipating plate 22 and apart form the other LEDs thereof.

The modulation assemblies 24, 25, and 26 are arranged in a preset array. The modulation assembly 24 includes a reflection element 241 and a connection mechanism 242, wherein the reflection element 241 is a triangular prism structure. The connection mechanism 242 perforates the reflection element 241 from one end surface to the other end surface of the reflection element 241, and pivotally connects to one pair of the female mechanisms 214. Among three side surfaces of the reflection elements, two side surfaces neighboring to the arrangement surface 211 are served as two reflection surfaces 2411 and 2412, and the other one far away from the arrangement surface 211 is served as a light-resistance surface 2413 for resisting injection light beams $IL_1$ and $IL_2$, as shown in FIG. 3, refracting directly refracting through the reflection element 241. Besides, the surface of the reflection surfaces can be the wavy surfaces as mentioned in prior arts.

Similarly, the modulation assembly 25 includes as reflection element 251 and a connection mechanism 252, and the reflection element 251 also includes two side surfaces served as two reflection surfaces 2511 and 2512, and a side surface served as a light resistance surface 2513. The modulation assembly 26 includes as reflection element 261 and a connection mechanism 262, and the reflection element 261 also includes two side surfaces served as two reflection surfaces 2611 and 2612, and a side surface served as a light resistance surface 2613. The constructional connection relation of the modulation assemblies 25 and 26 are the same as that of the modulation assembly 24.

Following up, we will provide further description to explain why the modulated lighting device 2 can provide modulated illumination toward the selected region 3. As shown in FIG. 3, when the LED 23*a* projects an injection light beam $IL_1$, part of the injection light beam $IL_1$ projects to the reflection surface 2411 to reflect an illumination light beam $LL_{11}$ passing through the illumination opening 213; and part of the injection light beam $IL_1$ directly passes through the illumination opening 213 and projects toward the selected region 3 to serve as another illumination light beam $LL_{12}$.

Similarly, when the LED 23*b* projects an injection light beam $IL_2$, part of the injection light beam $IL_2$ projects to the reflection surfaces 2511 and 2412 to respectively reflect two illumination beams $LL_{21}$ and $LL_{23}$ passing through the illumination opening 213; and part of the injection light beam $IL_2$ directly passes through the illumination opening 213 and projects toward the selected region 3 to serve as another illumination light beam $LL_{22}$.

When the LED 23*c* projects an injection light beam $IL_3$, part of the injection light beam $IL_3$ projects to the reflection surfaces 2611 and 2512 to respectively reflect two illumination beams $LL_{31}$ and $LL_{33}$ passing through the illumination opening 213; and part of the injection light beam $IL_3$ directly passes through the illumination opening 213 and projects toward the selected region 3 to serve as another illumination light beam $LL_{32}$.

When the LED 23*d* projects an injection light beam $IL_4$, part of the injection light beam $IL_4$ directly passes through the illumination opening 213 and projects toward the selected region 3 to serve as an illumination light beam $LL_{41}$; and part of the injection light beam $IL_4$ projects to the reflection surface 2612 to reflect another illumination beam $LL_{42}$ passing through the illumination opening 213.

Among the illumination light beams $LL_{11}$~$LL_{42}$ as mentioned, the illumination beams $LL_{12}$ and $LL_{12}$ are modulated in a modulation region B. Similarly, the illumination beams $LL_{21}$, $LL_{22}$ and $LL_{23}$ are modulated in a modulation region C. Nevertheless, the related illumination light beams passing through the modulation regions surrounded by dotted line can be modulated in the modulation regions. Thus, with the extension of the illumination beams $LL_{11}$~$LL_{42}$, the illumination beams $LL_{11}$~$LL_{42}$ can be further modulated for many times. Thus, the modulated lighting device 2 can provide modulated illumination toward the selected region 3.

Since the modulation assemblies 24, 25, and 26 are pivotally connected to the light box shell 21 neighboring to the illumination opening 213 via the connection mechanism 242, 252, and 262, modulation assemblies can adjust the injection angles of the injection light beams with respect to the modulation assemblies 24, 25, and 26 by rotating the modulation assemblies 24, 25, and 26, so as to adjust the injection angles, which the illumination light beams project to the selected region 3. Thus, it is able to adjust the illumination value provided to the selected region 3 by the modulated lighting device 2.

Figure 4:
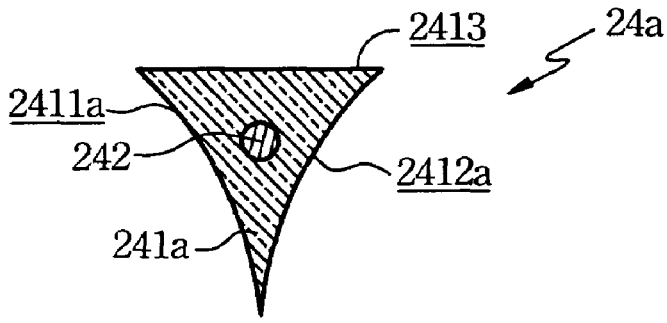
FIG. 4 illustrates the first application of the preferred embodiment of the present invention.

Please refer to FIG. 4, which illustrates the first application of the preferred embodiment of the present invention. In the first application, another modulation assembly 24*a* is used to replace the modulation assembly 24. With difference from the modulation assembly 24, the modulation assembly 24*a* has another reflection element 241*a* to replace the reflection element 241, and the reflection element 241*a* is substantial a triangular prism structure.

Among three side surfaces of the reflection element 241*a*, two side surfaces neighboring to the arrangement surface 211, as shown in FIG. 3, are served as two reflection surfaces 2411*a* and 2412*a*, and the other one far away from the arrangement surface 211 is served as the mentioned light-resistance surface 2413. The reflection surfaces 2411*a* and 2412*a* are concave surfaces to diffuse the illumination light beams for increasing the illumination area.

Figure 5:
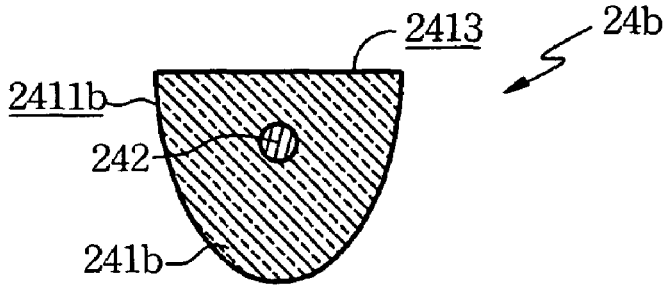
FIG. 5 illustrates the second application of the preferred embodiment of the present invention.

Please refer to FIG. 5, which illustrates the second application of the preferred embodiment of the present invention. In the second application, another modulation assembly 24*b* is used to replace the modulation assembly 24. With difference from the modulation assembly 24, the modulation assembly 24*b* has another reflection element 241*b* to replace the reflection element 241, the reflection element 241*b* is substantial a semi-cylindrical structure, and it also can be viewed as a structure similar to a triangular prism structure with two convex side surfaces.

The reflection element 241*b* has a peripheral surface neighboring to the arrangement surface 211, as shown in FIG. 3, and the peripheral surface is served as the reflection surface 2411*b*. The reflection element 241*b* further has a side surface far away from the arrangement surface 211, and the side surface is served as the mentioned light-resistance surface 2413. Besides, the reflection surface 2411*b* is a convex surface to concentrate the illumination light beams for decreasing illumination area.

Figure 6:
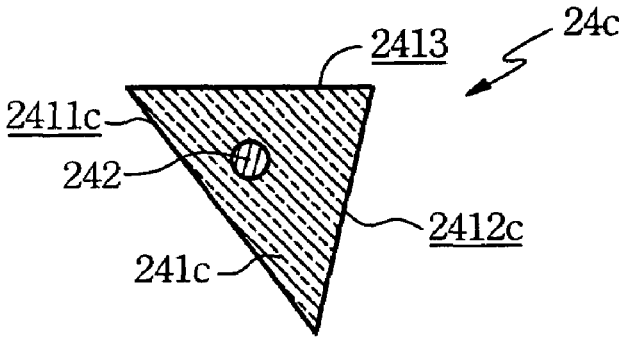
FIG. 6 illustrates the third application of the preferred embodiment of the present invention.

Please refer to FIG. 6, which illustrates the third application of the preferred embodiment of the present invention. In the third application, another modulation assembly 24*c* is used to replace the modulation assembly 24. With difference from the modulation assembly 24, the modulation assembly 24*c* has another reflection element 241*c* to replace the reflection element 241, and the reflection element 241*c* is substantial a triangular prism structure.

Among three side surfaces of the reflection element 241*c*, two side surfaces neighboring to the arrangement surface 211, as shown in FIG. 3, are served as two reflection surfaces 2411*c* and 2412*c*, and the other one far away from the arrangement surface 211 is served as the mentioned light-resistance surface 2413. The reflection surfaces 2411*c* and 2412*c* are formed in different slopes with respect to the light-resistance surface 2413, wherein the reflection surface 2411*c* is formed in a gentle slope with respect to the light-resistance surface 2413, and the reflection surface 2412*c* is formed in a steep slope with respect to the light-resistance surface 2413. Thus, the illumination light beams reflected form the reflection surface 2411*c* can be diffused to increase the illumination area, and the illumination light beams reflected form the reflection surface 2412*c* can be concentrated to decrease the illumination area.

Figure 7:
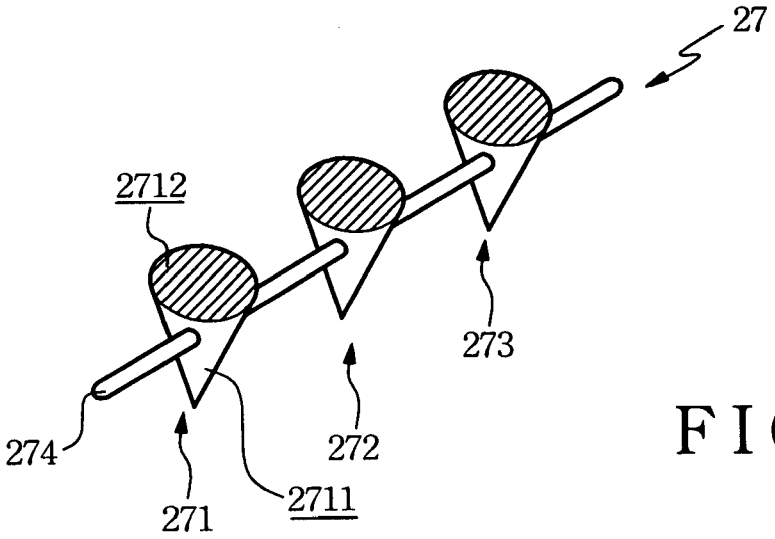
FIG. 7 illustrates the fourth application of the preferred embodiment of the present invention.
Figure 8:
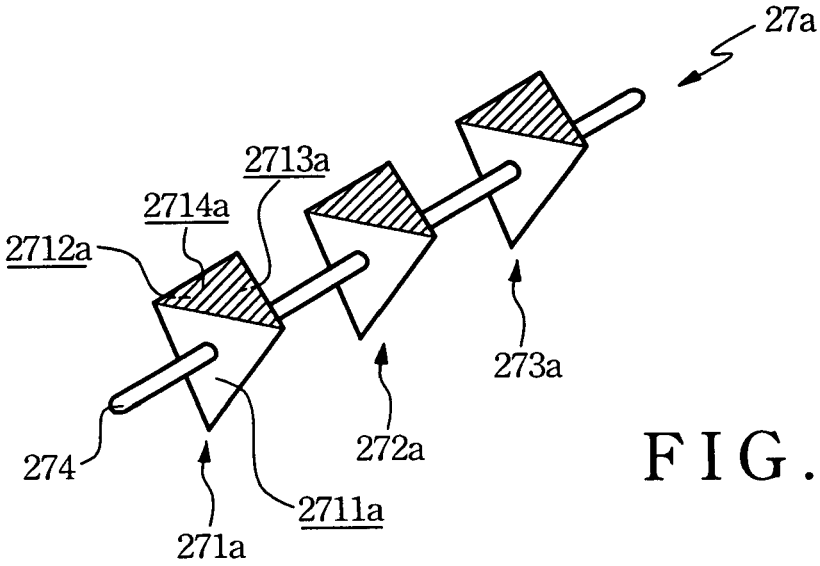
FIG. 8 illustrates the fifth application of the preferred embodiment of the present invention.
Figure 9:
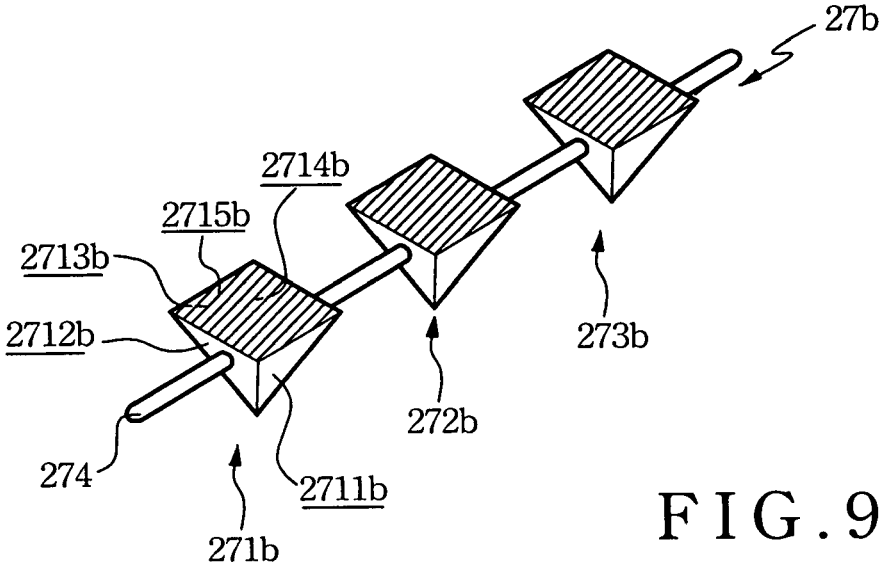
FIG. 9 illustrates the sixth application of the preferred embodiment of the present invention.

Please continuously refer to FIG. 7 to FIG. 9, which illustrates the other three applications of the preferred embodiment of the present invention, wherein the reflection elements are a plurality of taper structures, and also refer to FIG. 2 simultaneously. Among the drawings, FIG. 7 illustrates the fourth application of the preferred embodiment of the present invention. As shown in FIG. 7, in the fourth application, another modulation assembly 27 is used to replace the modulation assembly 24. The modulation assembly 27 has three reflection elements 271, 272, 273, and a connection mechanism 274.

The reflection element 271 is a circular cone structure having a tapered surface and a bottom surface. The tapered surface is served as a reflection surface 2711, and the bottom surface is served as a light-resistance surface 2712 for resisting the injection light beams to directly refract through the reflection element 271. The structures of the reflection elements 272 and 273 are the same as the structure of the reflection element 271. The connection element 274 perforates the reflection elements 271, 272, and 273, and connects to the female connection mechanism 214, as shown in FIG. 2.

Please refer to FIG. 8, which illustrates the fifth application of the preferred embodiment of the present invention. As shown in FIG. 8, in the fifth application, another modulation assembly 27*a* is used to replace the modulation assembly 24. The modulation assembly 27*a* has three reflection elements 271*a*, 272*a*, 273*a*, and the connection mechanism 274.

The reflection element 271*a* is a triangular pyramid structure having three tapered surfaces and a bottom surface. The tapered surfaces are served as three reflection surfaces 2711*a*, 2712*a*, and 2713*a*, and the bottom surface is served as a light-resistance surface 2714*a* for resisting the injection light beams to directly refract through the reflection element 271*a*. The structures of the reflection elements 272*a* and 273*a* are the same as the structure of the reflection element 271*a*. The connection element 274 perforates the reflection elements 271*a*, 272*a*, and 273*a*, and connects to the female connection mechanism 214, as shown in FIG. 2.

Please refer to FIG. 9, which illustrates the sixth application of the preferred embodiment of the present invention. As shown in FIG. 9, in the sixth application, another modulation assembly 27*b* is used to replace the modulation assembly 24. The modulation assembly 27*b* has three reflection elements 271*b*, 272*b*, and 273*b* and the connection mechanism 274.

The reflection element 271*b* is a quadratic pyramid structure having four tapered surfaces and a bottom surface. The tapered surfaces are served as four reflection surfaces 2711*b*, 2712*b*, 2713*b*, and 2714*b*, and the bottom surface is served as a light-resistance surface 2715*b* for resisting the injection light beams to directly refract through the reflection element 271*b*. The structures of the reflection elements 272*b* and 273*b* are the same as the structure of the reflection element 271*b*. The connection element 274 perforates the reflection elements 271*b*, 272*b*, and 273*b*, and connects to the female connection mechanism 214, as shown in FIG. 2.

After reading above description, people skilled in related arts can easily realize that in the preferred embodiments are the six applications, all reflection elements have light-resistance surface for resisting injection light beams to directly refract through thereof; while in practice, the reflection elements also can be made of light-transmissible material, and unnecessary to have the light-resistance surfaces. Thus, part of the injection light beams can also directly refract through the reflection element to serve as the illumination light beams, modulate with neighboring illumination light beams, and then provide modulated illumination toward the selected region.

Similarly, in the preferred embodiments are the six applications, all reflection elements are solid structures, while in practice, the reflection elements also can be hollow structures for saving the cost of material. Meanwhile the graphical characteristics of the reflection elements as mentioned in the first, second, and third applications can also be applied to the fourth, fifth, and sixth applications respectively.

Additionally, the amounts of the modulation assemblies, the reflection elements and the LEDs are not limited in the amounts as mentioned above. Furthermore, it is able to combination the characteristics of the preferred embodiment and the six applications to assemble the modulated lighting device to meet the illumination requirements of one or more selected regions.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A modulated lighting device being applied to provide a modulated illumination toward at least one selected region, and comprising:

a light box shell, comprising:

at least one arrangement surface located inside the light box shell;

at least one illumination surface located outside the light box shell; and at least one illumination opening formed on the illumination surface;

a heat-dissipating plate arranged on the arrangement surface of the light box shell for dissipating a lighting heat generated by providing the modulated illumination;

a plurality of lighting emitting diodes (LED) arranged on the arrangement surface for providing a plurality of injection light beams; and plurality of modulation assemblies arranged in a preset array, pivotally connected to the light box shell neighboring to the illumination opening, and each modulation assembly comprising:

at least one reflection element having at least one reflection surface neighboring to the arrangement surface for reflecting the injection light beams to generate at least one illumination light beam; and at least one connection mechanism for perforating the reflection element to pivotally connect to the light box shell neighboring to the illumination opening;

wherein each of the illumination light beams reflected from one of the modulation assemblies passes through the illumination opening and modulates with the neighbor illumination light beams so as to provide the modulated illumination.

2. The modulated lighting device as claimed in claim 1, wherein the reflection element is made of a light-transmissible material for making part of the injection light beams directly refract through thereof to serve as the illumination light beam.

3. The modulated lighting device as claimed in claim 1, wherein the light box shell has a plurality of female connection mechanisms located between the illumination surface and arrangement surface neighboring to the illumination opening for the connection mechanisms of the modulation assemblies being pivotally connected into thereof.

4. The modulated lighting device as claimed in claim 3, wherein the female connection mechanisms are a plurality of pairs of connection grooves.

5. The modulated lighting device as claimed in claim 3, wherein the female connection mechanisms are a plurality of pairs of connection holes.

6. The modulated lighting device as claimed in claim 1, wherein the reflection element is formed in a prism structure, and the connection mechanism perforates two end surfaces of the reflection element and connects to the light box shell neighboring to the illumination opening.

7. The modulated lighting device as claimed in claim 6, wherein the prism structure is a triangular prism structure, and two of three side surfaces of the reflection element neighboring to the arrangement surface are the reflection surfaces.

8. The modulated lighting device as claimed in claim 7, wherein one of the three side surfaces of the reflection element far away from the arrangement surface is a light-resistance surface for resisting the injection light beam to directly refract through thereof.

9. The modulated lighting device as claimed in claim 1, wherein the prism structure is substantially a triangular prism structure having three side surfaces, two of the three side surfaces of the reflection element neighboring to the arrangement surface are served as the reflection surfaces, and each of the reflection surfaces is a concave surface.

10. The modulated lighting device as claimed in claim 9, wherein one of the three side surfaces of the reflection element far away from the arrangement surface is served as a light-resistance surface for resisting the injection light beam to directly refract through thereof.

11. The modulated lighting device as claimed in claim 1, wherein the prism structure is substantially a triangular prism structure having three side surfaces, one of the three side surfaces of the reflection element far away from the arrangement surface is served as a light-resistance surface for resisting the injection light beam to directly refract through thereof.

12. The modulated lighting device as claimed in claim 11, wherein two of the three side surfaces of the reflection element neighboring to the arrangement surface are served as the reflection surfaces and respectively formed in two different slopes with respect to the light-resistance surface.

13. The modulated lighting device as claimed in claim 1, wherein the reflection element is substantially a semi-cylindrical structure, the semi-cylindrical structure has a peripheral surface neighboring to the arrangement surface, the peripheral surface is served as the reflection surface, and the reflection surface is a convex surface.

14. The modulated lighting device as claimed in claim 13, wherein the reflection element has a side surface far away from the arrangement surface, the side surface is served as a light-resistance surface for resisting the injection light beam to directly refract through thereof.

15. The modulated lighting device as claimed in claim 1, wherein the modulation assembly comprises a plurality of said reflection elements, each of the reflection element is formed in a taper structure, and the connection mechanism perforates the reflection elements.

16. The modulated lighting device as claimed in claim 15, wherein each of the reflection elements has at least one tapered surface served as the reflection surface.

17. The modulated lighting device as claimed in claim 15, wherein each one of the reflection elements has a bottom surface served as a light-resistance surface for resisting the injection light beam to directly refract through thereof to provide the modulate illumination toward the selected region.

18. The modulated lighting device as claimed in claim 15, wherein the taper structure is a circular cone structure.

19. The modulated lighting device as claimed in claim 15, wherein the taper structure is a pyramid structure.

20. The modulated lighting device as claimed in claim 1, wherein the reflection surface is a wavy reflection surface.

* * * * *